US007696977B2

(12) United States Patent
Lee et al.

(10) Patent No.: US 7,696,977 B2
(45) Date of Patent: Apr. 13, 2010

(54) APPARATUS AND METHOD FOR DRIVING DISPLAY PANEL WITH TEMPERATURE COMPENSATED DRIVING VOLTAGE

(75) Inventors: Jae-hoon Lee, Yongin-si (KR); Yhong-deug Ma, Suwon-si (KR)

(73) Assignee: Samsung Electronics Co., Ltd. (KR)

( * ) Notice: Subject to any disclaimer, the term of this patent is extended or adjusted under 35 U.S.C. 154(b) by 680 days.

(21) Appl. No.: 11/701,227

(22) Filed: Feb. 1, 2007

(65) Prior Publication Data

US 2007/0182694 A1 Aug. 9, 2007

(30) Foreign Application Priority Data

Feb. 7, 2006 (KR) ..... 10-2006-0011779

(51) Int. Cl.
*G09G 3/36* (2006.01)

(52) U.S. Cl. ..... 345/101; 345/204

(58) Field of Classification Search ..... 345/87–88, 345/90, 94–96, 98–101, 204, 210–211, 214
See application file for complete search history.

(56) References Cited

U.S. PATENT DOCUMENTS 5,936,603 A 8/1999 Lippmann et al.
6,037,920 A * 3/2000 Mizutome et al. ..... 345/87
6,326,959 B1 * 12/2001 Tanaka ..... 345/211
6,803,899 B1 * 10/2004 Masazumi et al. ..... 345/101
6,806,871 B1 10/2004 Yasue
6,980,062 B2 * 12/2005 Fujita ..... 331/176
7,038,654 B2 * 5/2006 Naiki et al. ..... 345/101
7,466,300 B2 * 12/2008 Naiki et al. ..... 345/101

FOREIGN PATENT DOCUMENTS

JP 10-333123 12/1998
JP 2004-317623 11/2004
KR 20010060254 A 7/2001
KR 20040066658 A 7/2004

* cited by examiner

*Primary Examiner*—Richard Hjerpe
*Assistant Examiner*—Mansour M Said
(74) *Attorney, Agent, or Firm*—Mills & Onello, LLP

(57) ABSTRACT

Provided is a method and an apparatus for driving a display panel with a temperature compensated driving voltage, which comprises a temperature sensor, a temperature section register, a comparing unit, a voltage register, a voltage controller and a driver. The comparing unit compares temperature data output from the temperature sensor to temperature section data stored in the temperature section register and outputs comparison data having predetermined bits. The voltage controller selects voltage data corresponding to the comparison data from the voltage data stored in the voltage register and outputs a voltage control signal corresponding to the selected voltage data. The driver outputs a driving voltage corresponding to the voltage control signal to the display panel from among the different driving voltages.

24 Claims, 9 Drawing Sheets

FIG. 6A

| TEMPERATURE | DT (4 bit) |
|---|---|
| ~ −30° C | 0 0 0 0 |
| −30°C ~ −20°C | 0 0 0 1 |
| −20°C ~ −10°C | 0 0 1 0 |
| −10°C ~ 0°C | 0 0 1 1 |
| 0°C ~ 10°C | 0 1 0 0 |
| 10°C ~ 20°C | 0 1 0 1 |
| 20°C ~ 30°C | 0 1 1 0 |
| 30°C ~ 40°C | 0 1 1 1 |
| 40°C ~ 50°C | 1 0 0 0 |
| 50°C ~ 60°C | 1 0 0 1 |
| 60°C ~ 70°C | 1 0 1 0 |
| 70°C ~ 80°C | 1 0 1 1 |
| 80°C ~ | 1 1 0 0 |

FIG. 6B

| TEMPERATURE SECTION | TEMPERATURE SECTION DATA |
|---|---|
| ~ −20° C | G1 |
| −20°C ~ −10°C | G2 |
| −10°C ~ 40°C | G3 |
| 40°C ~ 50°C | G4 |
| 50°C ~ 60°C | G5 |
| 60°C ~ 70°C | G6 |
| 70°C ~ 80°C | G7 |
| 80°C ~ | G8 |

FIG. 6C

| TEMPERATURE SECTION | D1 | D2 | D3 | D4 | D5 | D6 | D7 | D8 |
|---|---|---|---|---|---|---|---|---|
| 1 | 1 | 0 | 0 | 0 | 0 | 0 | 0 | 0 |
| 2 | 0 | 1 | 0 | 0 | 0 | 0 | 0 | 0 |
| 3 | 0 | 0 | 1 | 0 | 0 | 0 | 0 | 0 |
| 4 | 0 | 0 | 0 | 1 | 0 | 0 | 0 | 0 |
| 5 | 0 | 0 | 0 | 0 | 1 | 0 | 0 | 0 |
| 6 | 0 | 0 | 0 | 0 | 0 | 1 | 0 | 0 |
| 7 | 0 | 0 | 0 | 0 | 0 | 0 | 1 | 0 |
| 8 | 0 | 0 | 0 | 0 | 0 | 0 | 0 | 1 |

FIG. 6D

| D1 ~ D8 | EV | Vop |
|---|---|---|
| 1000 0000 | EV1 | Vop1 |
| 0100 0000 | EV2 | Vop2 |
| 0010 0000 | EV3 | Vop3 |
| 0001 0000 | EV4 | Vop4 |
| 0000 1000 | EV5 | Vop5 |
| 0000 0100 | EV6 | Vop6 |
| 0000 0010 | EV7 | Vop7 |
| 0000 0001 | EV8 | Vop8 |

APPARATUS AND METHOD FOR DRIVING DISPLAY PANEL WITH TEMPERATURE COMPENSATED DRIVING VOLTAGE

CROSS-REFERENCE TO RELATED PATENT APPLICATION

This application claims the benefit of Korean Patent Application No. 10-2006-0011779, filed on Feb. 7, 2006, in the Korean Intellectual Property Office, the disclosure of which is incorporated herein in its entirety by reference.

BACKGROUND OF THE INVENTION

1. Field of the Invention

The present invention relates to an apparatus and a method for driving a display panel with a temperature compensated driving voltage, and more particularly, to an apparatus and a method for driving a display panel by dividing a temperature range into predetermined temperature sections and outputting different driving voltages for the respective predetermined temperature sections.

2. Description of the Related Art

A liquid crystal display (LCD) panel controls transmissivity of a liquid crystal of the LCD in response to video data that is to be displayed as an image corresponding to the video data. When a driving voltage corresponding to the video data is applied to the electrodes of the LCD panel, the molecules of the liquid crystal of the LCD placed between the electrodes are rearranged in response and, thus, the transmissivity of the liquid crystal of the LCD panel is controlled. The luminance of the image corresponding to the video data is determined by the degree to which back light transmits through the liquid crystal of the LCD panel and the color of the image is determined by color filters through which the back light that has transmitted through liquid crystal is input thereto, such that the image is displayed on the LCD panel.

A variation in the temperature of the liquid crystal of the LCD panel rearranges the characteristics of the liquid crystal of the LCD panel. That is, when the temperature of the liquid crystal of the LCD panel varies, the transmissivity and threshold voltage Vth, which is a minimum driving voltage required to rearrange the molecules of the liquid crystal of the LCD panel, change.

FIG. 1 is a graph that illustrates the relationship between the temperature T of the liquid crystal and a driving voltage Vop. The horizontal axis represents the temperature T of the liquid crystal and the vertical axis represents the driving voltage Vop applied to the electrodes of an LCD panel to rearrange the molecules of the liquid crystal of the LCD panel. When the driving voltage Vop varies in response to a temperature variation as illustrated in FIG. 1, the display quality of the LCD panel does not deteriorate due to the temperature variation. That is, the driving voltage Vop corresponds to an ideal driving voltage Vop_Ideal of the LCD panel.

As illustrated in FIG. 1, the ideal driving voltage Vop_Ideal decreases as the temperature T of the liquid crystal of the LCD panel increases. That is, a relatively low driving voltage Vop can control the rearrangement of the molecules of the liquid crystal when the temperature T of the liquid crystal of the LCD panel is high. On the contrary, a relatively high driving voltage Vop can control the rearrangement of the molecules of the liquid crystal of the LCD panel when the temperature T of the liquid crystal is low.

FIG. 2 illustrates a block diagram of an apparatus for driving a display panel with a temperature compensated driving voltage. Referring to FIG. 2, the display panel driving apparatus includes a controller 208, a first driver 206, a second driver 204 and a display panel 202.

The controller 208 controls the driving voltages VopX and VopY in response to a temperature variation. The first driver 206 applies the driving voltage VopX controlled by the controller 208 to an X electrode, e.g., a common electrode of the display panel 202. The second driver 204 applies the driving voltage VopY to a Y electrode, e.g., a segment electrode of the display panel 202, which can be an LCD panel.

FIGS. 3*a* and 3*b* illustrate driving voltages that are controlled in response to variations in temperature. A driving voltage Vop having the characteristic curve of FIG. 3*a* or 3*b* can drive the display panel of FIG. 2.

FIGS. 3*a* and 3*b* illustrate ideal driving voltages Vop_Ideal and temperature-compensated driving voltages Vop_C. The temperature-compensated driving voltage Vop_C of FIG. 3*a* is linear with a negative slope. When the driving voltage Vop conforms to the temperature-compensated driving voltage Vop_C and is controlled in response to variations in temperature, the adaptivity of the driving voltage Vop to the temperature variation is low because the driving voltage has only one slope. Low adaptivity of the driving voltage to the temperature variation means a large difference between the ideal driving voltage Vop_Ideal and the temperature-compensated driving voltage Vop_C.

The temperature-compensated driving voltage curve Vop_C of FIG. 3*b* has a plurality of slopes S1, S2, S3, S4 and S5. Specifically, the temperature-compensated driving voltage curve Vop_C has the slope S1 at a temperature less than −10° C., the slope S2 at a temperature between −10° C. and 40° C.°, the slope S3 at a temperature between 40° C. and 60° C.°, the slope S4 at a temperature between 60° C. and 80° C.° and the slope S5 at a temperature higher than 80° C.°. When the driving voltage Vop conforms to the temperature-compensated driving voltage curve Vop_C of FIG. 3*b*, the adaptivity of the driving voltage Vop to a temperature variation improves because the driving voltage Vop has different slopes for respective temperature sections. When comparing FIGS. 3*a* and 3*b*, the differences between the ideal driving voltage curve Vop_Ideal and the temperature-compensated driving voltage curve Vop_C in FIG. 3*b* is smaller than it is in FIG. 3*a*. However, the difference between the ideal driving voltage curve Vop_Ideal and the temperature-compensated driving voltage curve Vop_C is large in temperature sections where the slopes abruptly vary (portions indicated by dotted ovals in FIG. 3*b*).

Many attempts have been made to reduce the difference between the ideal driving voltage Vop_Ideal and the temperature-compensated driving voltage Vop_C such that the display quality of a display panel does not deteriorate due to variations in temperature.

SUMMARY OF THE INVENTION

Provided are an apparatus and method for driving a display panel, which controls a driving voltage such that the driving voltage approximates an ideal driving voltage, thereby preventing the display quality of the display panel from deteriorating due to temperature variations.

According to an aspect of the present invention, there is provided an apparatus for driving a display panel with a temperature compensated driving voltage, which comprises a temperature sensor, a temperature section register, a comparing unit, a voltage register, a voltage controller, and a driver. The temperature sensor is configured to output temperature data indicating a temperature corresponding to one of a set of predetermined temperature intervals. The temperature section register is configured to store temperature section data that respectively represents temperature sections when a predetermined temperature range is divided into the temperature sections. The comparing unit is configured to compare the temperature data to the temperature section data and to output a set of comparison data having a corresponding predetermined pattern of bits. The voltage register is configured to store voltage data corresponding to different driving voltages, wherein each of the different driving voltages corresponds to a different one of the temperature sections. The voltage controller is configured to select voltage data corresponding to the set of comparison data, from the voltage data stored in the voltage register, and to output a voltage control signal corresponding to the selected voltage data. The driver is configured to output to the display panel a driving voltage corresponding to the voltage control signal, the output driving voltage from among the stored different driving voltages.

The apparatus can be configured to adaptively output a different driving voltage in response to a variation in temperature, wherein the adaptivity of the driving voltage to variations in temperature improves as widths of the temperature sections decrease, such that a display quality of the display panel does not deteriorate even when a temperature varies.

The temperature sections can have different widths.

The temperature section register can be configured to set the widths of the temperature sections in response to signals received from a display panel manufacturer, a display panel user, or an external controller The temperature section register can be configured to couple to at least one of an OTP memory or an MTP memory, and the widths of the temperature sections can be set by a program stored in the at least one OTP memory and MTP memory.

The driving voltages can be defined in intervals corresponding to the temperature sections, and the intervals of the driving voltages can decrease as the widths of the temperature sections decrease.

The voltage register can be configured to set the different driving voltages in response to signals received from a display panel manufacturer, a display panel user, or an external controller.

The voltage register can be configured to couple to at least one of an OTP memory or an MTP memory, and the different driving voltages can be set by a program stored in the at least one OTP memory and MTP memory.

The comparing unit can include N comparators corresponding to N number of temperature sections.

Each of the N comparators can be configured to take as inputs the temperature data from the temperature sensor and a corresponding one of the temperature section data from the temperature section register.

Each comparator of the N comparators can be configured to output a corresponding comparison data, from the set of comparison data, as 1-bit data at a level indicating that the temperature corresponding to the temperature data is in the temperature section corresponding to the temperature section data for the comparator.

The comparing unit can be configured to output N-bit comparison data composed of 1-bit data respectively output by each of the N comparators.

The voltage controller can be configured to receive the N-bit comparison data in which one of the N bits is at a first level and the other bits are at a second level, and can be further configured to select voltage data corresponding to the comparison data based on the position of the bit from the N-bit comparison data having the first level.

The driver can be configured to apply the output driving voltage to electrodes of the display panel.

The temperature sensor can have a hysteresis output characteristic.

The temperature intervals can become smaller and the number of the temperature data can increase as the sensitivity of the temperature sensor increases.

According to another aspect of the present invention, there is provided a method for driving a display panel with a temperature compensated driving voltage, the method comprising: dividing a predetermined temperature range into predetermined temperature sections and storing temperature section data respectively representing the temperature sections; matching different driving voltages with the respective temperature sections and storing voltage data corresponding to the different driving voltages; comparing temperature data output from a temperature sensor to the temperature section data and outputting comparison data having predetermined bits; selecting voltage data corresponding to the comparison data from the voltage data and outputting a voltage control signal corresponding to the selected voltage data; and outputting a driving voltage corresponding to the voltage control signal from among the different driving voltages to the display panel.

The intervals of the driving voltages can decrease as the widths of the temperature sections decrease.

The adaptivity of a driving voltage applied to the display panel as a temperature varies can improve as the intervals of the different driving voltages decrease, such that the display quality of the display panel does not deteriorate even when a temperature varies.

The temperature sections can have different widths.

The number of bits of the comparison data can be equal to the number of the temperature sections.

The method can include applying the driving voltage corresponding to the voltage control signal to the electrodes of the display panel to drive the display panel with a compensated temperature.

The display panel is an LCD panel.

BRIEF DESCRIPTION OF THE DRAWINGS

The above and other features and advantages of the present invention will become more apparent by describing in detail exemplary embodiments with reference to the attached drawings, in which:

FIGS. 6*a*, 6*b*, 6*c* and 6*d* illustrate tables for explaining the operation of the display panel driving apparatus of FIG. 5.

DETAILED DESCRIPTION OF EXEMPLARY EMBODIMENTS

Figure 1:
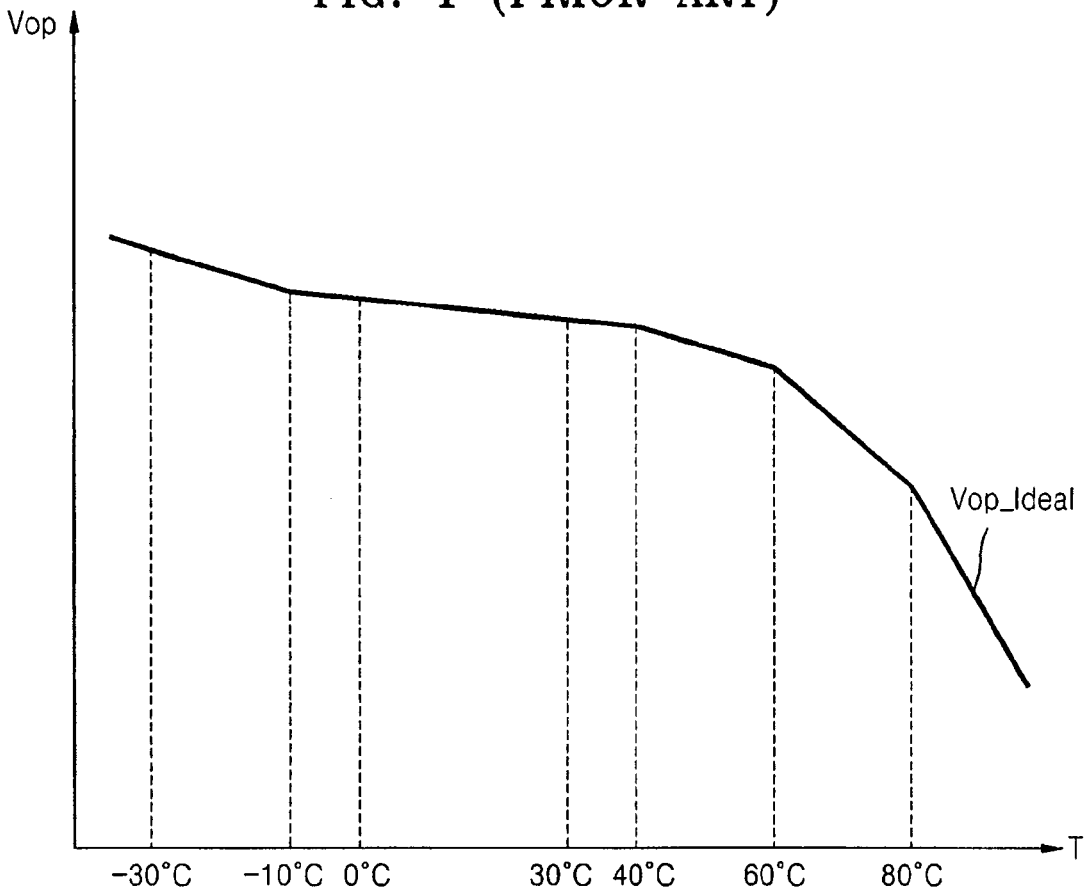
FIG. 1 (PRIOR ART)
FIG. 1 is a graph illustrating the relationship between the temperature of a liquid crystal of an LCD display panel and an ideal driving voltage, in accordance with the prior art.
Figure 2:
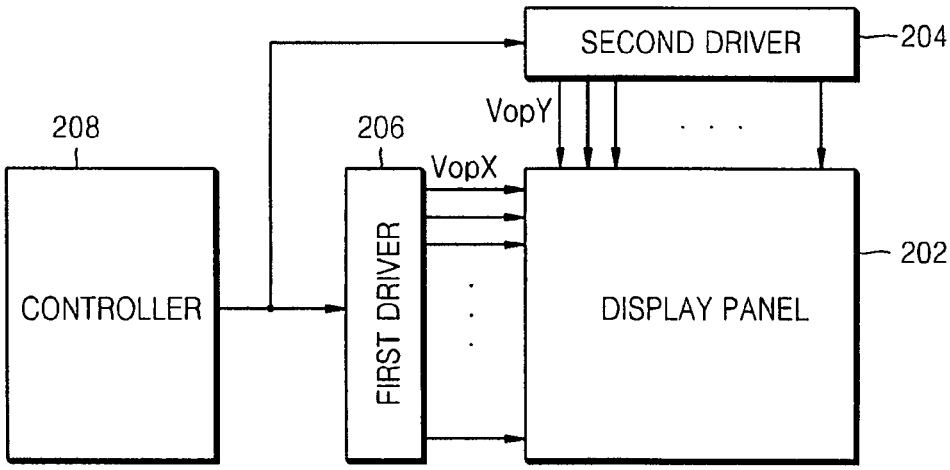
FIG. 2 (PRIOR ART)
FIG. 2 illustrates a block diagram of a prior art apparatus for driving a display panel with a temperature compensated driving voltage.

Aspects of the present invention will now be described more fully with reference to the accompanying drawings, in which exemplary embodiments are shown. The invention can, however, be embodied in many different forms and should not be construed as being limited to the embodiments set forth herein Throughout the drawings, like reference numerals refer to like elements.

Figure 4:
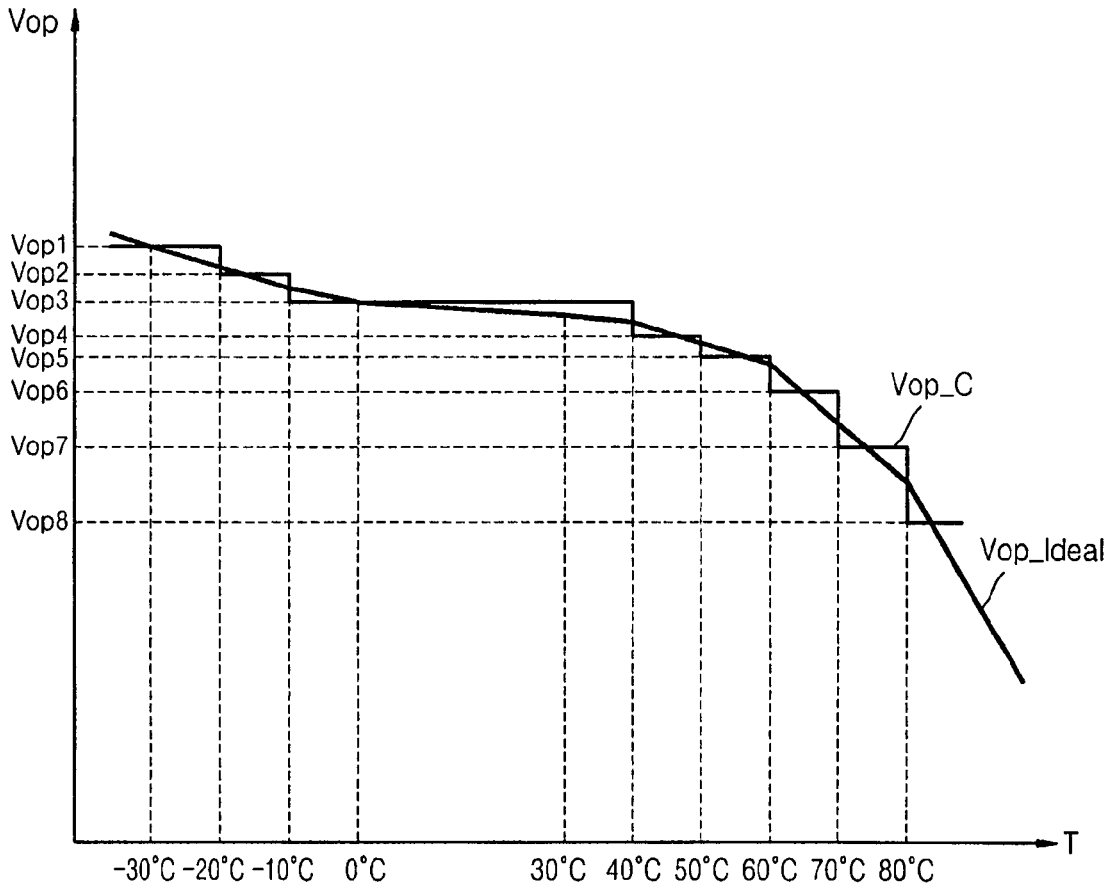
FIG. 4 illustrates an embodiment of a driving voltage controlled in response to variations in temperature according to aspects of the present invention.

FIG. 4 illustrates a graph illustrating the relationship between a driving voltage Vop and the temperature T of a liquid crystal of a display panel. FIG. 4 illustrates an ideal driving voltage Vop_Ideal and a temperature-compensated driving voltage Vop_C. In FIG. 4, the horizontal axis represents the temperature T of a liquid crystal of a display panel and the vertical axis represents the driving voltage Vop applied to the electrodes of a display panel.

The temperature-compensated driving voltage Vop_C has a level Vop1 at a temperature less than −20° C., a level Vop2 at a temperature ranging from −20° C. to −10° C., a level Vop3 at a temperature ranging from −10° C. to 40° C., a level Vop4 at a temperature ranging from 40° C. to 50° C., a level Vop5 at a temperature ranging from 50° C. to 60° C., a level Vop6 at a temperature ranging from 60° C. to 70° C., a level Vop7 at a temperature ranging from 70° C. to 80° C., and a level Vop8 at a temperature higher than 80° C.

In accordance with aspects of the present invention, to drive a display panel with a temperature compensated driving voltage Vop_C, a predetermined temperature range is divided into sections. As illustrated in FIG. 4, for example, a temperature range from −40° C. to 90° C. in FIG. 4 can be divided into predetermined temperature sections, such as a temperature section less than −20° C., a temperature section from −20° C. to −10° C., a temperature section from −10° C. to 40° C., a temperature section from 40° C. to 50° C., a temperature section from 50° C. to 60° C., a temperature section from 60° C. to 70° C., a temperature section from 70° C. to 80° C. ° and a temperature section higher than 80° C.

Driving voltages are applied to the display panel in accordance with the respective temperature sections. As illustrated in FIG. 4, for example, a voltage Vop1 is applied when the temperature is in the temperature section of less than −20° C., a voltage Vop2 is applied when the temperature is in the temperature section of −20° C. to −10° C., a voltage Vop3 is applied when the temperature is in the temperature section of −10° C. to 40° C., a voltage Vop4 is applied when the temperature is in the temperature section of 40° C. to 50° C., Vop5 is applied when the temperature is in the temperature section of 50° C. to 60° C., a voltage Vop6 is applied when the temperature is in the temperature section of 60° C. to 70° C., a voltage Vop7 is applied when the temperature is in the temperature section of 70° C. to 80° C. and a voltage Vop8 is applied when the temperature is in the temperature section higher than 80° C.

Figure 3A:
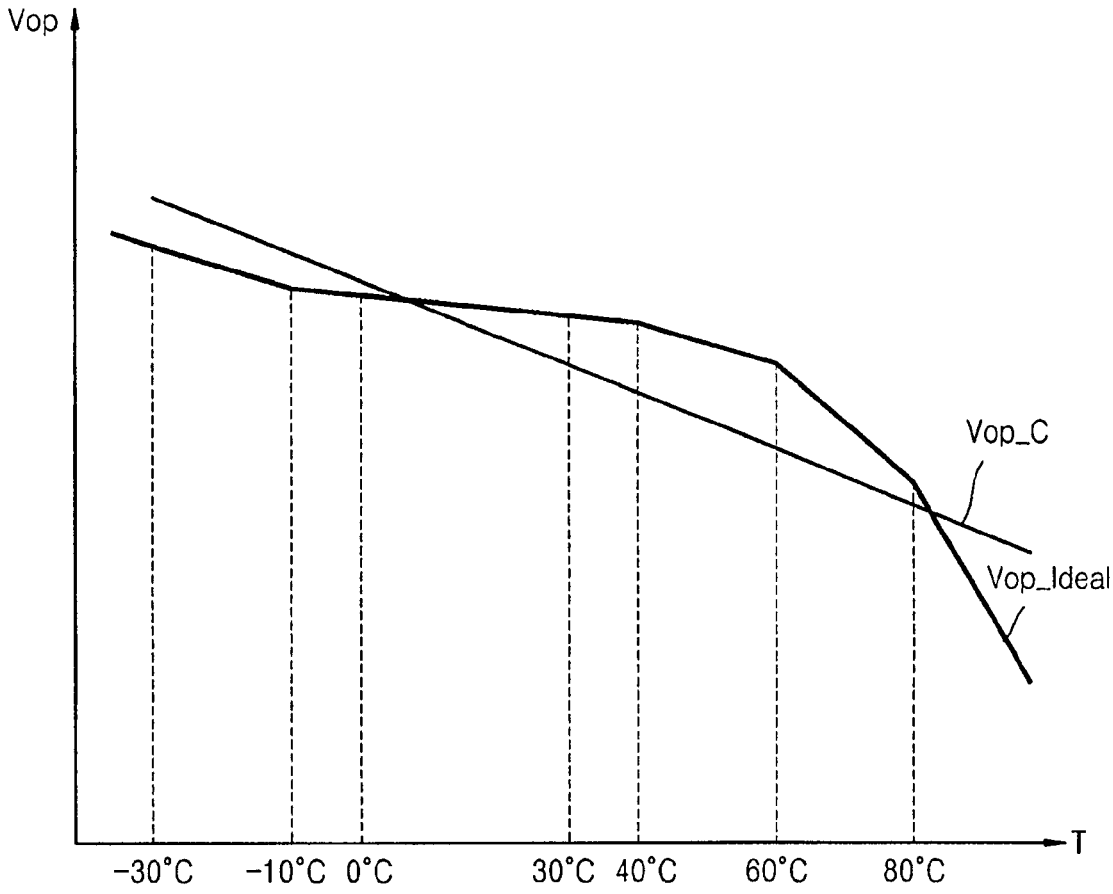
FIG. 3A (PRIOR ART)
FIGS. 3*a* and 3*b* illustrate driving voltages controlled in response to variations in temperature, in accordance with the prior art.
Figure 3B:
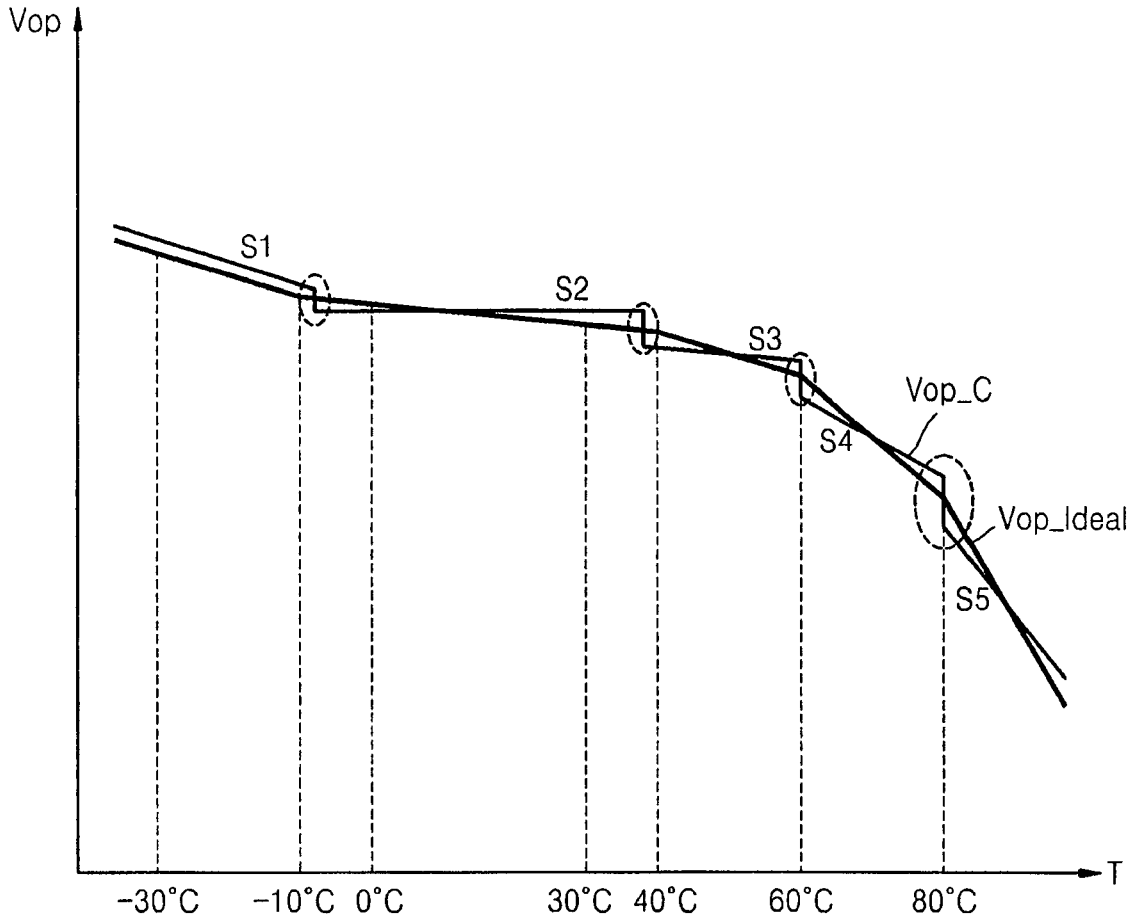
FIG. 3B (PRIOR ART)

The prior art display panel driving apparatus divides a predetermined temperature range into predetermined temperature sections and uses a driving voltage curve having different slopes for the respective temperature sections, as illustrated in FIG. 3*b*. However, in accordance with aspects of the present invention, predetermined temperature ranges are divided into a predetermined number of temperature sections and different driving voltages are applied to the respective predetermined number of temperature sections, as illustrated in FIG. 4, wherein the slope is the same, i.e., 0.

As the widths of the predetermined number of temperature sections decrease, the adaptivity of the driving voltage Vop with respect to the variations in temperature improves. That is, as the widths of the predetermined number of temperature sections decrease, the intervals of the driving voltages (for example, Vop1 through Vop8 of FIG. 4) decrease, and, thus, the difference between the ideal driving voltage Vop_Ideal and the temperature-compensated driving voltage Vop_C decreases. Consequently, the adaptivity of the driving voltage Vop with respect to variations in temperature improves. When the adaptivity improves, the driving voltage Vop conforms to the ideal driving voltage Vop_Ideal, even if the temperature T varies. Accordingly, the display quality of the display panel does not deteriorate during variations in temperature of the display panel.

While FIG. 4 illustrates eight temperature sections, the temperature range can be divided more finely to meet a required adaptivity as the driving voltage Vop varies with temperature. As described above, as the temperature range is finely divided, the difference between the ideal driving voltage Vop_Ideal and the temperature-compensated driving voltage Vop_C becomes smaller.

Figure 5:
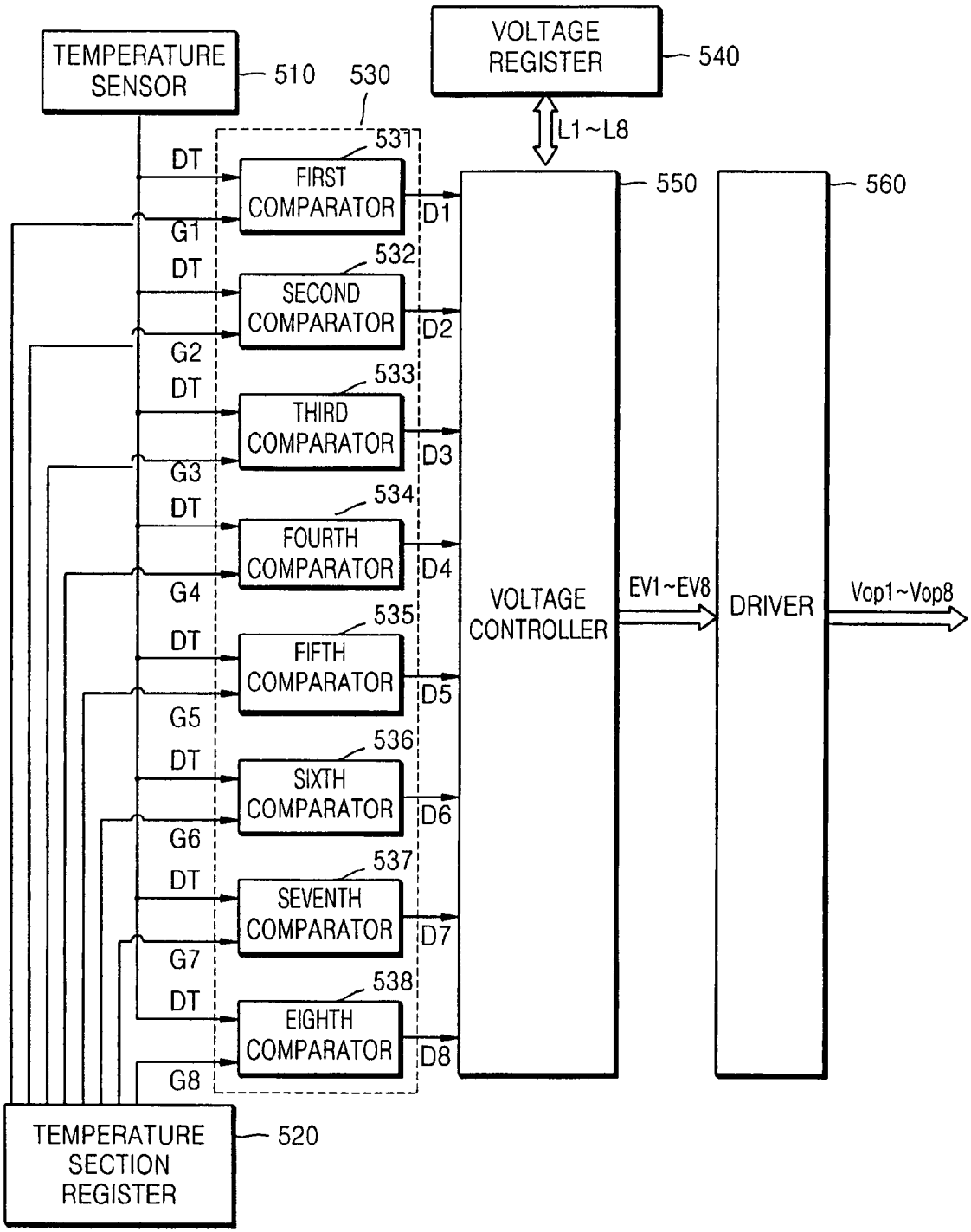
FIG. 5 illustrates a block diagram of an embodiment of an apparatus for driving a display panel according to aspects of the present invention.

FIG. 5 illustrates a block diagram of an embodiment of an apparatus for driving a display panel according to aspects of the present invention. Referring to FIG. 5, the apparatus includes a temperature sensor 510, a temperature section register 520, a comparing unit 530, a voltage register 540, a voltage controller 550 and a driver 560. The comparing unit 530 includes a plurality of comparators 531 through 538. The display panel driving apparatus of FIG. 5 applies the driving voltages Vop1 through Vop8 conforming to the temperature-compensated driving voltage curve Vop_C, illustrated in FIG. 4 to the electrodes of the display panel.

The temperature sensor 510 is configured to output different temperature data DT corresponding to different predetermined temperature intervals, respectively. The temperature data DT will be explained in detail later with reference to FIG. 6*a*. The temperature data DT output from the temperature sensor 510 is input to the plurality of comparators 531 through 538.

The temperature section register 520 is configured to store temperature section data G1 through G8 for the respective temperature sections. For example, when a temperature range from −40° C. to 90° C. is divided into a first temperature section less than −20° C., a second temperature section from −20° C. to −10° C., a third temperature section from −10° to 40° C., a fourth temperature section from 40° C. to 50° C., a fifth temperature section from 50° C. to 60° C., a sixth temperature section from 60° C. to 70° C., a seventh temperature section from 70° C. to 80° C., and an eighth temperature section higher than 80° C., as illustrated in FIG. 4, temperature section data G1 representing the first temperature section, temperature section data G2 representing the second temperature section, temperature section data G3 representing the third temperature section, temperature section data G4 representing the fourth temperature section, temperature section data G5 representing the fifth temperature section, temperature section data G6 representing the sixth temperature section, temperature section data G7 representing the seventh temperature section and temperature section data G8 representing the eighth temperature section are stored in the temperature section register 520. The temperature section data G1 through G8 are respectively input to the comparators 531 through 538.

A display panel manufacturer, a display panel user, or an external controller (not shown) can be connected via any known type of communication path or network to the temperature section register 520 to set the widths of the temperature sections. Furthermore, the widths of the temperature sections can be set by a program stored in a one-time programmable (OTP) memory or a multi-time programmable (MTP) memory. Specifically, the program that sets the widths of the temperature sections can be stored in the OTP memory or MTP memory that can be configured of an erasable and programmable read only memory (EPROM) and the temperature section data G1 through G8 stored in the temperature section register 520 is reset, if required.

The temperature sections can have different widths. In the case of FIG. 4, as an example, the fourth temperature section (40° C. through 50° C.), the fifth temperature section (50° C. through 60° C.), the sixth temperature section (60° C. through 70° C.) and the seventh temperature section (70° C. through 80° C.) have a width corresponding to 10° C. and the third temperature section (−10° C. through 40° C.) has a width corresponding to 50° C. The third temperature section has a width larger than those of the other temperature sections because the third temperature section has a relatively flat temperature characteristic.

The comparing unit 530 is configured to compare the respective temperature data DT to the temperature section data G1 through G8 and to output comparison data having predetermined bits (for example, 8-bit data for D1 through D8 in FIG. 5). The comparing unit 530 includes comparators corresponding to the temperature sections. That is, the comparing unit 530 includes N comparators when the number of the temperature sections is N. In the case of FIGS. 4 and 5, the comparing unit 530 includes eight comparators 531 through 538 because the temperature range between −40° through 90° C. is divided into the eight temperature sections.

The comparators 531 through 538 are configured to respectively receive the temperature data DT and the temperature section data G1 through G8. The comparators 531 through 538 are configured to respectively output 1-bit data at a high or low level when the temperature corresponding to the temperature data DT belongs to the temperature section corresponding to one of the temperature section data G1 through G8. Consequently, the comparing unit 530 outputs N-bit comparison data composed of 1-bit data, respectively output from the N comparators 531 through 538.

Consider a case where the temperature of a liquid crystal is 25° C., for example. The temperature sensor 510 outputs temperature data DT corresponding to 25° C. to the comparators 531 through 538. The third comparator 533 receiving the temperature section data G3 representing the third temperature section from −10° C. to 40° C. outputs 1-bit data D3 at a high level because 25° C. corresponds to the temperature data DT belonging to the temperature section corresponding to the temperature section data G3. The other comparators 531, 532, 534, 545, 536, 537, and 538 respectively output 1-bit data D1, D2, D4, D5, D6, D7, and D8 at a low level, since 25° C. corresponds to the temperature data DT that does not belong to the temperature sections corresponding to the temperature section data G1, G2, G4, G5, G6, G7 and G8. Consequently, the comparing unit 530 outputs 8-bit comparison data 0010 0000 composed of data D1 through D8, in this example. The comparing unit 530 can be set such that the comparing unit 530 outputs 8-bit comparison data 1101 1111 by converting a high level into a low level, as an alternative example.

The voltage register 540 is configured to store voltage data L1 through L8 corresponding to the different respective driving voltages Vop1 through Vop8 that are applied for the temperatures in their respective temperature sections.

The display panel manufacturer, the display panel unit, or the external controller (not shown) can be connected to the voltage register 540 to set the driving voltages Vop1 through Vop8. A program stored in an OTP memory or a MTP memory, as examples, can set the driving voltages Vop1 through Vop8.

The voltage controller 550 is configured to select voltage data, which corresponds to the comparison data D1 through D8 received from the comparing unit 530, from the voltage data L1 through L8 and to output a voltage control signal EV1, EV2, EV3, EV4, EV5, EV6, EV7 or EV8 corresponding to the selected voltage data.

For example, when the comparing unit 530 outputs 8-bit comparison data 0010 0000 composed of D1 through D8 to the voltage controller 550, the voltage controller 550 selects the voltage data L3 corresponding to the comparison data 0010 0000 based on the position of the high-level bit or the third bit of the comparison data 0010 0000, comprising data D1 through D8.

The driver 560 is configured to output one of the driving voltages Vop1 through Vop8, which respectively correspond to one of the voltage control signals EV1 through EV8 output from the voltage controller 550, to the display panel. That is, the driver 560 applies the driving voltage (one of Vop1 through Vop8) corresponding to the voltage control signal (a corresponding one of EV1 through EV8) to the electrodes of the display panel. Consequently, a temperature compensated driving voltage drives the display panel.

As the volume of a radio is adjusted to control speaker power, the voltage controller 550 of the display panel driving apparatus according to aspects of the present invention controls the electronic volume based on the comparison data D1 through D8 and the voltage data L1 through L8, and outputs the voltage control signal (one of EV1 through EV8) corresponding to the controlled electronic volume to the driver 560. The driver 560 applies the corresponding driving voltage (e.g., one of Vop1 through Vop8) corresponding to the received voltage control signal (e.g., one of EV1 through EV8) to the electrodes of the display panel.

An embodiment of an operation of the display panel driving apparatus of FIG. 5 will now be explained with reference to FIGS. 6*a*, 6*b*, 6*c*, and 6*d*, which more particularly illustrate exemplary tables for explaining the operation of the display panel driving apparatus.

FIG. 6*a* exemplifies the temperature data DT output from the temperature sensor 510 of FIG. 5. Referring to FIG. 6*a*, the temperature sensor 510 outputs 4-bit temperature data DT for every temperature interval of 10° C. When the temperature of the liquid crystal is 25° C., for example, the 4-bit temperature data DT 0110 is output since 25° C. belongs to the temperature interval ranging from 20° C. to 30° C. While FIG. 6*a* exemplifies thirteen temperature intervals, the number of temperature intervals increases as the sensitivity of the temperature sensor 510 increases. That is, as the sensitivity of the temperature sensor 510 increases, the widths of the temperature intervals decrease and the number of bits of the temperature data DT increases.

The temperature sensor 510 has a hysteresis output characteristic configured to prevent temperature section sensing error when the temperature sensor 510 senses a temperature at a boundary between two of temperature intervals of FIG. 6*a*. In the case of a temperature sensor without a hysteresis output characteristic, it is substantially impossible to determine which one of 0101 and 0110 is to be output when the temperature of a liquid crystal is 20° C., for example. On the contrary, in the case of a temperature sensor having the hysteresis output characteristic, data corresponding to the boundaries between temperature intervals is predetermined. Thus, it is possible to estimate which one of 0101 and 0110 is to be output when the temperature of the liquid crystal is 20° C.

FIG. 6*b* exemplifies the temperature section data G1 through G8 stored in the temperature section register 520. A display panel manufacturer, a display panel user, or an external controller (not shown) can be connected to the temperature section register 520 to divide a predetermined temperature range from −20° C. to 80° C. into eight temperature sections, as shown in FIG. 6*b*. Stored in the temperature section register 520 are the temperature section data G1 representing the first temperature section less than −20° C., the temperature section data G2 representing the second temperature section ranging from −20° C. to −10° C., the temperature section data G3 representing the third temperature section ranging from −10° C. to 40° C., the temperature section data G4 representing the fourth temperature section ranging from −40° C. to 50° C., the temperature section data G5 representing the fifth temperature section ranging from 50° C. to 60° C., the temperature section data G6 representing the sixth temperature section ranging from 60° C. to 70° C., the temperature section data G7 representing the seventh temperature section ranging from 70° C. to 80° C., and the temperature section data G8 representing the eighth temperature section higher than 80° C.

FIG. 6*c* exemplifies the comparison data D1 through D8 output from the comparing unit 530. For example, 1000 0000 is output when the temperature of the liquid crystal is in the first temperature section less than −20° C., 0100 0000 is output when the temperature of liquid crystal is in the second temperature section ranging from −20° C. to −10° C., 0010 0000 is output when the temperature of liquid crystal is in the third temperature section ranging from −10° C. to 40° C., and 0001 0000 is output when the temperature of liquid crystal is in the fourth temperature section ranging from −40° C. to 50° C. Furthermore, 0000 1000 is output when the temperature of liquid crystal is in the fifth temperature section ranging from 50° C. to 60° C., 0000 0100 is output when the temperature of liquid crystal is in the sixth temperature section ranging from 60° C. to 70° C., 0000 0010 is output when the temperature of liquid crystal is in the seventh temperature section ranging from 70° C. to 80° C. and 0000 0001 is output when the temperature of liquid crystal is in the eighth temperature section greater than 80° C.

FIG. 6*d* shows the relationship among the comparison data D1 through D8, the voltage control signals EV1 through EV8, and the driving voltages Vop1 through Vop8 of FIG. 5. When comparison data 0010 0000 is input to the voltage controller 550, for example, the voltage controller 550 outputs the voltage control signal EV3 based on the comparison data 0010 0000 and the voltage data L3 corresponding to 0010 0000. The driver 560 applies the driving voltage Vop3 corresponding to the voltage control signal EV3 to the electrodes of the display panel to drive the display panel where a temperature is varying. Corresponding relationships exist for each of the other comparison data, voltage control signals, and driving voltages.

An embodiment of a method of driving a display panel with a compensated temperature according to aspects of the present invention will now be explained.

First of all, a predetermined temperature range is divided into a predetermined number of temperature sections and temperature section data (G1 through G8 of FIG. 5, for example) representing the temperature sections is stored.

Then, different driving voltages (Vop1 through Vop8 of FIG. 5, for example) are set for the respective temperature sections and voltage data (L1 through L8 of FIG. 5, for example) corresponding to the driving voltages is stored.

Subsequently, temperature data DT output from the temperature sensor 510 is compared to the temperature section data G1 through G8 and comparison data D1 through D8 is output.

Voltage data corresponding to the comparison data is selected from the voltage data L1 through L8 and a voltage control signal (one of EV1 through EV8 of FIG. 5) corresponding to the selected voltage data is output.

A driving voltage (one of Vop1 through Vop8 of FIG. 5) corresponding to the voltage control signal among the driving voltages Vop1 through Vop8 is output to the display panel.

The narrower the widths of the temperature sections, the narrower the intervals of the driving voltages Vop1 through Vop8. Accordingly, the adaptivity of the driving voltage to variations in temperature is improved in order to prevent the display quality of the display panel from deteriorating due to the variations in temperature. The temperature sections can have different widths, as illustrated in FIG. 4.

The number of bits of the comparison data D1 through D8 output from the comparing unit 530 is equal to the number of comparators (531 through 538 of FIG. 5) included in the comparing unit 530 and correspondingly to the number of temperature sections (eight in the case of FIGS. 4, 5 and 6*b*).

As described above, in accordance with aspects of the present invention, deterioration of the display quality of a display panel due to variations in temperature can be substantially prevented. The adaptivity of a driving voltage for driving the display panel with variations in temperature improves as the widths of the temperature sections decrease.

While aspects the present invention has been particularly shown and described with reference to exemplary embodiments, it will be understood by those of ordinary skill in the art that various changes in form and details can be made therein without departing from the spirit and scope of the present invention. It is intended by the following claims to claim that which is literally described and all equivalents thereto, including all modifications and variations that fall within the scope of each claim.

What is claimed is:

1. An apparatus for driving a display panel with a temperature compensated driving voltage, the apparatus comprising:

a temperature sensor configured to output temperature data indicating a temperature corresponding to one of a set of predetermined temperature intervals;

a temperature section register configured to store temperature section data that respectively represents temperature sections when a predetermined temperature range is divided into the temperature sections;

a comparing unit configured to compare the temperature data to the temperature section data and to output comparison data having predetermined bits;

a voltage register configured to store voltage data corresponding to different driving voltages, wherein each of the different driving voltages corresponds to one of the temperature sections;

a voltage controller configured to select voltage data corresponding to the comparison data, from the voltage data stored in the voltage register, and to output a voltage control signal corresponding to the selected voltage data; and a driver configured to output to the display panel a driving voltage corresponding to the voltage control signal from among the different driving voltages.

2. The apparatus of claim 1, wherein the apparatus is configured to adaptively output a different driving voltage in response to a variation in temperature, wherein the adaptivity of the driving voltage to the variations in temperature improves as widths of the temperature sections decrease, such that a display quality of the display panel does not deteriorate even when the temperature varies.

3. The apparatus of claim 2, wherein the intervals of the different driving voltages decrease as the widths of the temperature sections decrease.

4. The apparatus of claim 3, wherein the voltage register is configured to set the voltage levels of the different driving voltages in response to signals received from a display panel manufacturer, a display panel user, or an external controller.

5. The apparatus of claim 3, wherein the voltage register is configured to be coupled to an OTP memory or an MTP memory, and the voltage levels of the different driving voltages are set by a program stored in the OTP memory or the MTP memory.

6. The apparatus of claim 1, wherein the temperature sections can have different widths.

7. The apparatus of claim 6, wherein the temperature section register is configured to set the widths of the temperature sections in response to signals received from a display panel manufacturer, a display panel user, or an external controller.

8. The apparatus of claim 6, wherein the temperature section register is configured to be coupled to an OTP memory and an MTP memory, and the widths of the temperature sections are set by a program stored in the OTP memory or the MTP memory.

9. The apparatus of claim 1, wherein the comparing unit includes N comparators corresponding to N number of temperature sections.

10. The apparatus of claim 9, wherein each of the N comparators is configured to take as inputs the temperature data from the temperature sensor and a corresponding one of the temperature section data from the temperature section register.

11. The apparatus of claim 10, wherein each of the N comparators is configured to output 1-bit of comparison data at a logic level indicating whether the temperature corresponding to the temperature data is in the temperature section corresponding to the temperature section data.

12. The apparatus of claim 11, wherein the comparing unit outputs N-bit comparison data composed of 1-bit data respectively output by each of the N comparators.

13. The apparatus of claim 12, wherein the voltage controller is configured to receive the N-bit comparison data in which one of the N bits is at a first level and the other bits are at a second level, and is further configured to select voltage data corresponding to the N-bit comparison data based on the position of the bit having the first level.

14. The apparatus of claim 13, wherein the driver is configured to apply the driving voltage corresponding to the voltage control signal from among the different driving voltages to electrodes of the display panel.

15. The apparatus of claim 1, wherein the temperature sensor has a hysteresis output characteristic.

16. The apparatus of claim 1, wherein the temperature intervals become smaller and the number of bits of temperature data increases as the sensitivity of the temperature sensor increases.

17. The apparatus of claim 1, wherein the display panel is an LCD panel.

18. A method for driving a display panel with a temperature compensated driving voltage, the method comprising:

dividing a predetermined temperature range into predetermined temperature sections and storing temperature section data respectively representing the temperature sections;

matching different driving voltages with the respective temperature sections and storing voltage data respectively corresponding to the different driving voltages;

comparing temperature data output from a temperature sensor to the temperature section data and outputting comparison data having predetermined bits;

selecting voltage data corresponding to the comparison data and outputting a voltage control signal corresponding to the selected voltage data; and outputting a driving voltage corresponding to the voltage control signal from among the different driving voltages to the display panel.

19. The method of claim 18, wherein the intervals of the different driving voltages decrease as the widths of the temperature sections decrease.

20. The method of claim 19, wherein the adaptivity of a driving voltage to the variations in temperature improves as the intervals of the different driving voltages decrease, such that the display quality of the display panel does not deteriorate even when a temperature varies.

21. The method of claim 18, wherein the temperature sections can have different widths.

22. The method of claim 18, wherein the number of bits of the comparison data is equal to the number of the temperature sections.

23. The method of claim 18, wherein the driving voltage corresponding to the voltage control signal is applied to the electrodes of the display panel to drive the display panel with temperature compensation.

24. The method of claim 18, wherein the display panel is an LCD panel.

* * * * *